US012698606B2

(12) United States Patent
Dondlinger et al.

(10) Patent No.: US 12,698,606 B2
(45) Date of Patent: Aug. 4, 2026

(54) BARRIER SYSTEMS WITH IMPACT RESISTANT RAILS THAT EXTEND ALONG THE FLOOR

(71) Applicant: Rite-Hite Holding Corporation, Milwaukee, WI (US)

(72) Inventors: Jason Dondlinger, Bellevue, IA (US); Nick Casey, Cascade, IA (US); Tony Duesing, Bellevue, IA (US); Aaron Wiegel, Milwaukee, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 708 days.

(21) Appl. No.: 17/984,969

(22) Filed: Nov. 10, 2022

(65) Prior Publication Data

US 2023/0151570 A1 May 18, 2023

Related U.S. Application Data

(60) Provisional application No. 63/357,366, filed on Jun. 30, 2022, provisional application No. 63/278,948, filed on Nov. 12, 2021.

(51) Int. Cl.
*E01F 15/04* (2006.01)
*E01F 15/00* (2006.01)

(52) U.S. Cl.
CPC ..... *E01F 15/0423* (2013.01); *E01F 15/003* (2013.01); *E01F 15/0438* (2013.01); *E01F 15/0461* (2013.01)

(58) Field of Classification Search
CPC . E04H 17/14; E04H 17/1413; E04H 17/1447; E04H 17/1465; E04H 17/1488; E01F 15/04; E01F 15/0407; E01F 15/0423; E01F 15/043; E01F 15/0438; E01F 15/0453; E01F 15/0461
See application file for complete search history.

(56) References Cited

U.S. PATENT DOCUMENTS 2,557,002 A * 6/1951 Lathrop ..... E04F 11/181 256/65.12
2,946,568 A * 7/1960 Ogden ..... E04F 11/181 403/264

(Continued)

FOREIGN PATENT DOCUMENTS

CA 2459684 9/2005
EP 0866171 9/1998

(Continued)

OTHER PUBLICATIONS

International Searching Authority, "International Search Report and Written Opinion," issued in connection with PCT Application No. PCT/US22/49600, dated May 9, 2023, 21 pages.

(Continued)

*Primary Examiner* — Jonathan P Masinick
(74) *Attorney, Agent, or Firm* — Hanley, Flight & Zimmerman, LLC

(57) ABSTRACT

Barrier systems with impact resistant rails that extend along the floor are disclosed. A barrier system includes a base to be anchored to a floor. The base includes sidewalls defining a channel along a length of the base. The barrier system further includes a tube extending along the channel. A bottom edge of the tube to be below top edges of the sidewalls.

15 Claims, 14 Drawing Sheets

(56) References Cited

U.S. PATENT DOCUMENTS 3,462,126 A * 8/1969 Demanega ..... E01F 13/024 52/298
3,820,909 A * 6/1974 Schindler ..... F16B 7/04 403/205
3,921,960 A * 11/1975 Bright ..... E04H 17/1413 256/65.12
4,477,059 A * 10/1984 Willis ..... E04H 17/1413 403/292
5,312,089 A * 5/1994 Venegas, Jr. ..... E04F 11/181 403/260
6,142,453 A * 11/2000 Martin ..... E04H 17/1413 256/65.05
6,213,452 B1 * 4/2001 Pettit ..... E04F 11/1812 248/527
6,554,257 B1 * 4/2003 Kenton ..... E04G 21/3233 256/65.14
6,679,481 B2 * 1/2004 McNalley ..... E04H 17/1413 256/65.01
7,243,473 B2 * 7/2007 Terrels ..... E04C 3/32 52/843
8,424,851 B2 * 4/2013 Christoffer ..... E01F 13/022 256/65.14
9,066,493 B2 * 6/2015 Barzani ..... A01K 15/027
9,663,965 B2 * 5/2017 Ramon ..... E01F 13/022
11,236,511 B2 * 2/2022 Henderson ..... E04H 17/20
2004/0004211 A1 * 1/2004 McEnroe, Jr. ..... E04G 21/185 256/65.04
2004/0026679 A1 2/2004 Terrels et al.
2006/0255327 A1 * 11/2006 Johnston ..... E04H 17/1413 256/59
2012/0131879 A1 * 5/2012 Bergman ..... E04F 11/1812 52/704
2015/0197958 A1 * 7/2015 Wilson ..... E04H 17/14 256/10
2018/0283040 A1 * 10/2018 McCue ..... E04H 17/1465
2024/0401289 A1 * 12/2024 Dondlinger ..... B65G 69/287

FOREIGN PATENT DOCUMENTS

GB 2522278 A * 7/2015 ..... E01F 13/022
KR 100637844 B1 * 10/2006
KR 100899773 B1 * 5/2009
KR 100938507 B1 * 1/2010
KR 20110021168 A * 3/2011

OTHER PUBLICATIONS

International Searching Authority, "Invitation to Pay Additional Fees," issued in connection with PCT Application No. PCT/US22/49600, dated Mar. 17, 2023, 14 pages.
International Searching Authority, "Correction to International Search Report" issued in connection with PCT Application No. PCT/US22/49600, dated Jun. 2, 2023, 2 pages.
International Searching Authority, "International Preliminary Report on Patentability," issued in connection with International Application No. PCT/US2022/049600, issued on May 2, 2024, 12 pages.
Australian Government, IP Australia, "Examination Report No. 1," issued in connection with Australian Application No. 2022384251, issued on Mar. 25, 2025, 4 pages.
Australian Government, IP Australia, "Notice of Acceptance," issued in connection with Australian Patent Application No. 2022384251, issued on Dec. 16, 2025, 4 pages.

* cited by examiner

BARRIER SYSTEMS WITH IMPACT RESISTANT RAILS THAT EXTEND ALONG THE FLOOR

RELATED APPLICATIONS

This patent claims the benefit of U.S. Provisional Patent Application No. 63/278,948, which was filed on Nov. 12, 2021, and also claims the benefit of U.S. Provisional Patent Application No. 63/357,366, which was filed on Jun. 30, 2022. U.S. Provisional Patent Application No. 63/278,948 and U.S. Provisional Patent Application No. 63/357,366 are incorporated herein by reference in their entireties. Priority to U.S. Provisional Patent Application No. 63/278,948 and U.S. Provisional Patent Application No. 63/357,366 is claimed.

FIELD OF THE DISCLOSURE

This disclosure relates generally to barrier systems and, more particularly, to barrier systems with impact resistant rails that extend along the floor.

BACKGROUND

Barrier systems are often implemented on roadways, driveways, loading docks, rail or finger docks, factories, and warehouse floors. Some such barrier systems include one or more rails that extend horizontally between vertical posts. In some instances, the vertical posts are anchored to the floor to provide a barrier that is able to resist and/or withstand certain impacts to the posts and/or rails.

Figure 1:
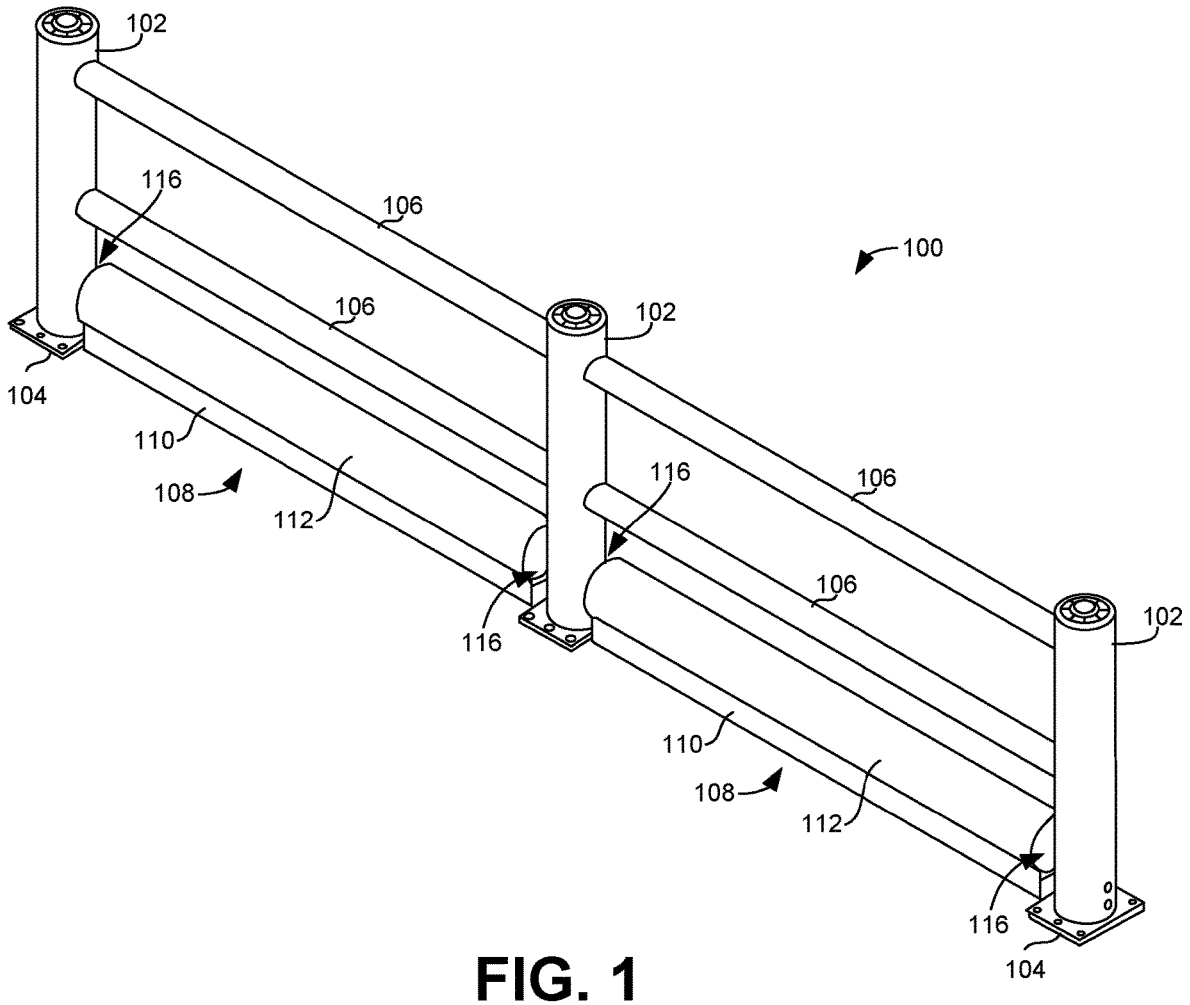
FIG. 1 illustrates an example barrier system constructed in accordance with teachings disclosed herein.

In general, the same reference numbers will be used throughout the drawing(s) and accompanying written description to refer to the same or like parts. The figures are not necessarily to scale. Instead, the thickness of the layers or regions may be enlarged in the drawings. As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another.

As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween.

As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts. As used herein, "approximately" and "about" refer to dimensions that may not be exact due to manufacturing tolerances and/or other real-world imperfections.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

DETAILED DESCRIPTION

Many barrier systems (also referred to herein as guard rail systems) include a plurality of spaced apart posts with rails extending therebetween. In some barrier systems, multiple rails may extend between adjacent posts at different locations along the height of the posts. Typically, the rails that extend between adjacent posts are spaced apart from the floor on which the posts rest and/or are anchored. As a result, it is possible for moving low profile objects such as pallets or forks from lift vehicles (e.g., fork trucks) to pass under the rails in the gap between the rail and the floor. Such scenarios give rise to the risk of impacts or harm to pedestrians, equipment, products, and/or structures on the opposite side of the barrier system. Examples disclosed herein reduce the risk of such scenarios occurring by implementing a rail that is directly attached to and extends along the floor without a gap between a top of the rail and the floor through which objects can pass. Such a rail that does not provide any gap between the rail and the floor is referred to herein as a floor rail. By contrast, for purposes of distinction, a rail that is spaced apart from the floor (e.g., there is a gap between the rail and the floor) is referred to herein as a guard rail.

FIG. 1 illustrates an example barrier system 100 constructed in accordance with teachings disclosed herein. As shown in the illustrated example, the barrier system 100 includes a plurality of posts 102 spaced apart from one another along a path defined for the barrier system 100. In this example, all of the posts 102 are arranged in a straight line. However, in other examples, the path of the barrier system may include corners and/or otherwise follow a non-straight line. The posts 102 are secured in their place via base plates 104 that are anchored to the ground or floor (e.g., using concrete anchors if the floor is concrete).

As shown in the illustrated example, separate guard rails 106 extend between adjacent ones of the posts 102 at different heights off the ground or floor. In this example, there are two guard rails 106 spaced apart from the ground or floor between adjacent posts 102. In other examples, there may be only one guard rail 106 between adjacent posts 102. In other examples, there may be more than two guard rails 106 between adjacent posts 102. While the guard rails 106 have a similar cross-sectional size and/or shape in this example, the cross-sectional size and/or shape may differ between the guard rails 106 in other examples.

In addition to the guard rails 106 that are spaced apart from the floor, the example barrier system 100 includes floor rails 108 that extend between adjacent ones of the posts 102. In this example, the floor rails 108 are anchored directly to the ground (e.g., via concrete anchors) independent of the posts 102 and associated base plates 104. In some examples, the anchoring system for the floor rails 108 may be integrated with the base plates 104 of the posts 102. Additionally or alternatively, the floor rails 108 may be directly attached to the posts 102. In this example, the floor rails 108 include an elongate rigid (e.g., metal (e.g., steel, cast iron, etc.)) base 110 with an impact resistant tube 112 positioned on top of and extending along the length of the base 110. More particularly, as detailed further below, the tube 112 is positioned within a channel defined by the base 110 such that the bottom edge of the tube 112 is below a top edge of the base 110. In some examples, the bottom edge of the tube 112 is urged into and secured within the channel to maintain the bottom edge of the tube 112 below the top edge of the base 110. This ensures that there is no gap between the floor and the top of the floor rail 108 (e.g., there are no gaps underneath the entirety of the floor rail 108 or between different components of the floor rail 108) through which objects can pass. In some examples, the tube 112 is made of a relatively rigid but resilient material (e.g., polypropylene impact copolymer) to enable the tube 112 to sustain an impact by being able to deform and absorb such an impact. Further, in some examples, the tube 112 has a diameter that is greater than a width of the base 110 such that the tube 112 is likely to be struck first during an impact to absorb some of the force of the impact before the base 110 is struck.

Figure 2:
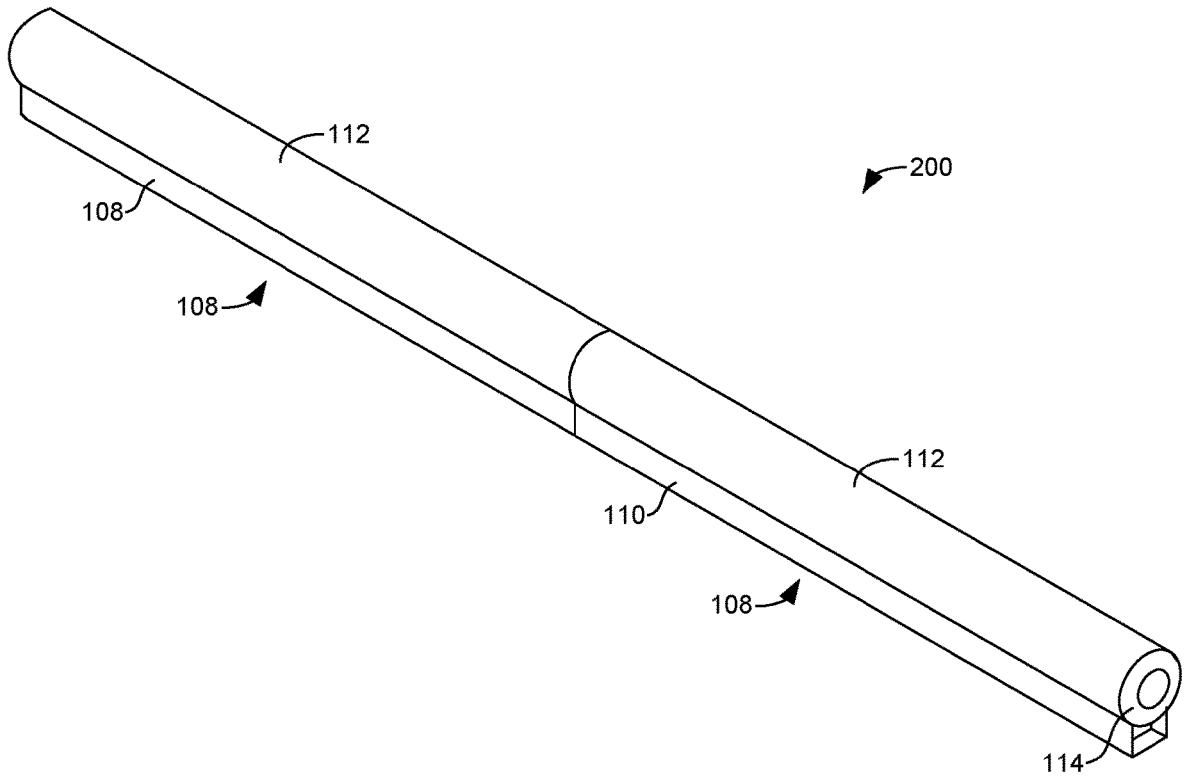
FIG. 2 illustrates another example barrier system constructed in accordance with teachings disclosed herein.

FIG. 2 illustrates another example barrier system 200 constructed in accordance with teachings disclosed herein. In this example, the posts 102 and the guard rails 106 are omitted and the floor rails 108 are used in a standalone implementation. That is, in this example, the floor rails 108 are mounted directly to the ground and directly adjacent to one another (i.e., without another structure therebetween). In the illustrated example, the floor rails 108 are positioned in a straight line. However, in other examples, the floor rails 108 may be positioned at any suitable angle relative to one another. In some examples, as shown in FIG. 2, one or both ends of the tube 112 is closed off by an end cap 114. In other examples, one or both ends of the tube may remain open. The end cap 114 shown in FIG. 2 may additionally or alternatively be used in connection with the floor rails 108 of the example barrier system 100 of FIG. 1. Although the floor rails 108 are shown and described as being mounted to a floor, in some examples, the floor rails 108 may be mounted to a wall or any other suitable structure to serve as a bumper to protect the structure and/or other objects adjacent the structure supporting the rails 108.

Figure 3:
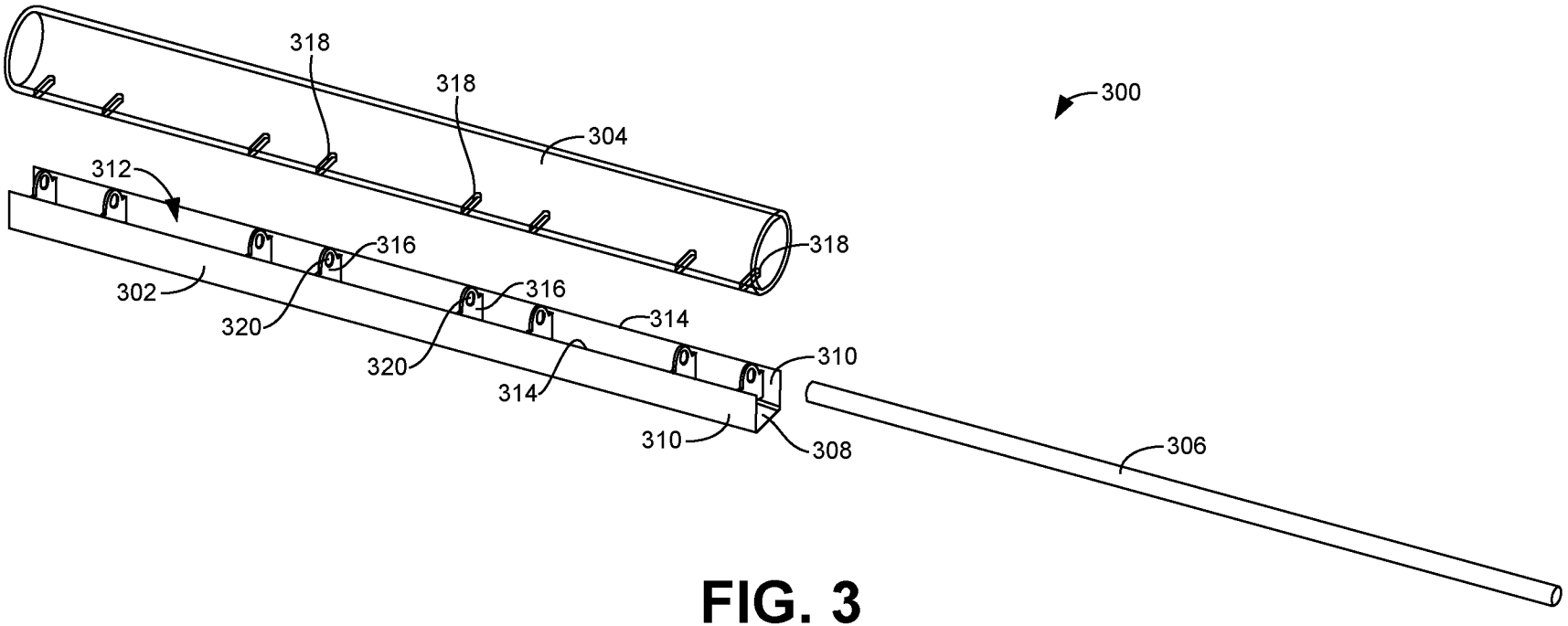
FIGS. 3-8 illustrate different views of an example floor rail that may be used to implement the example floor rails in the example barrier systems of FIGS. 1 and/or 2.
Figure 4:
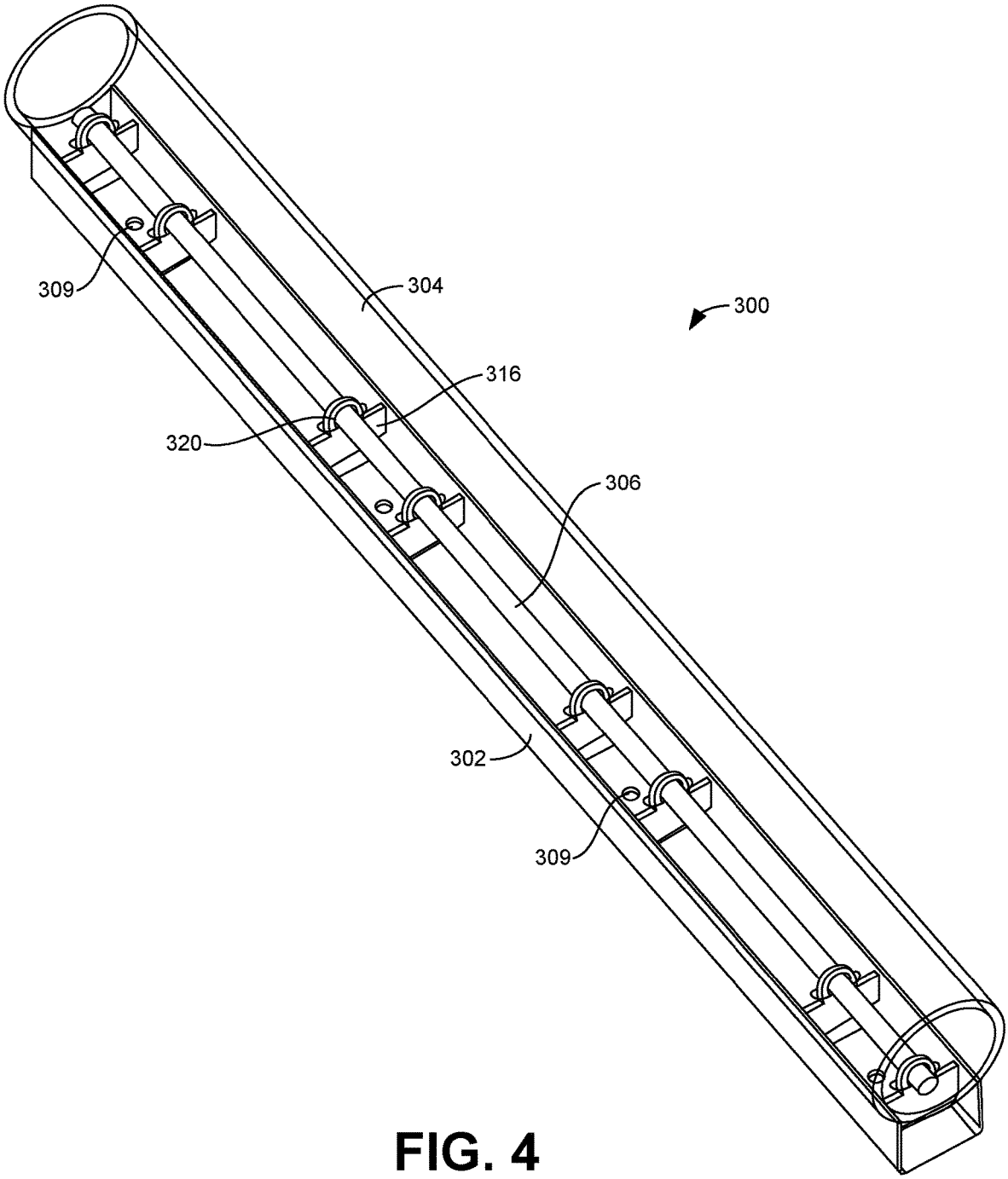
Figure 5:
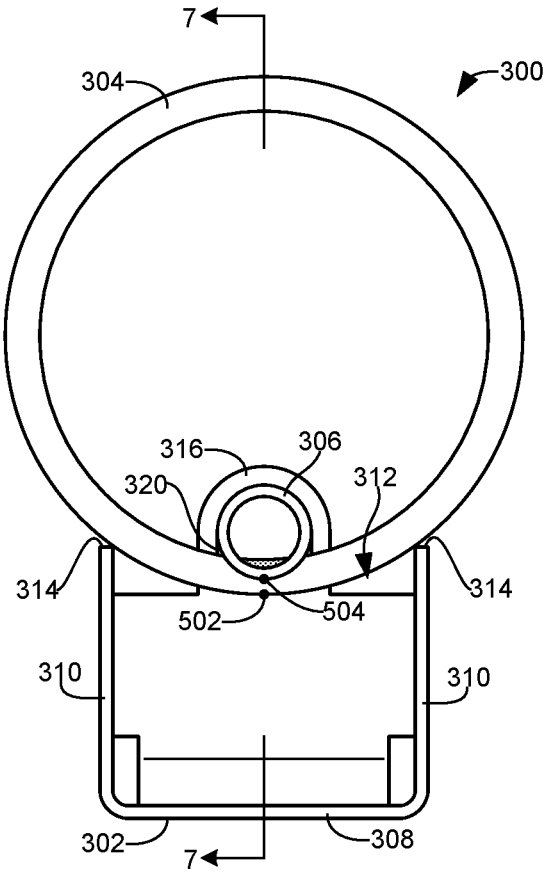
Figure 6:
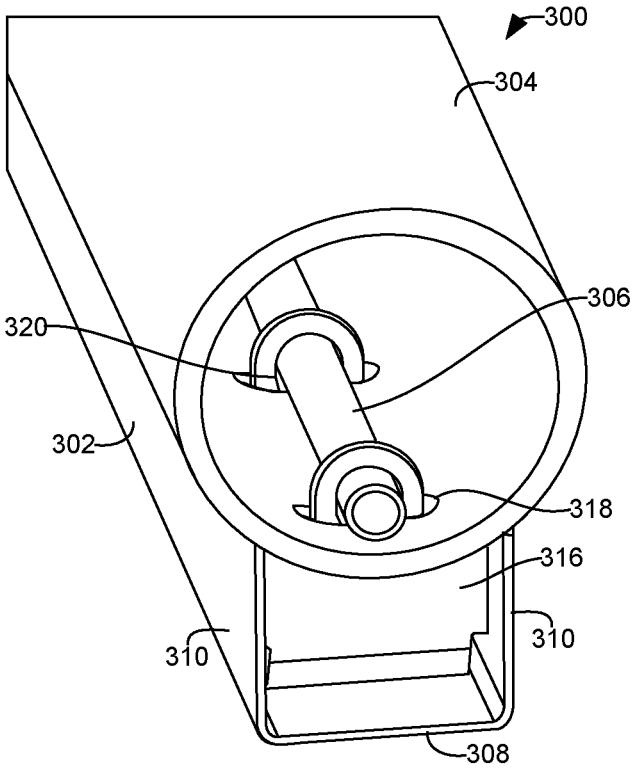
Figure 7:
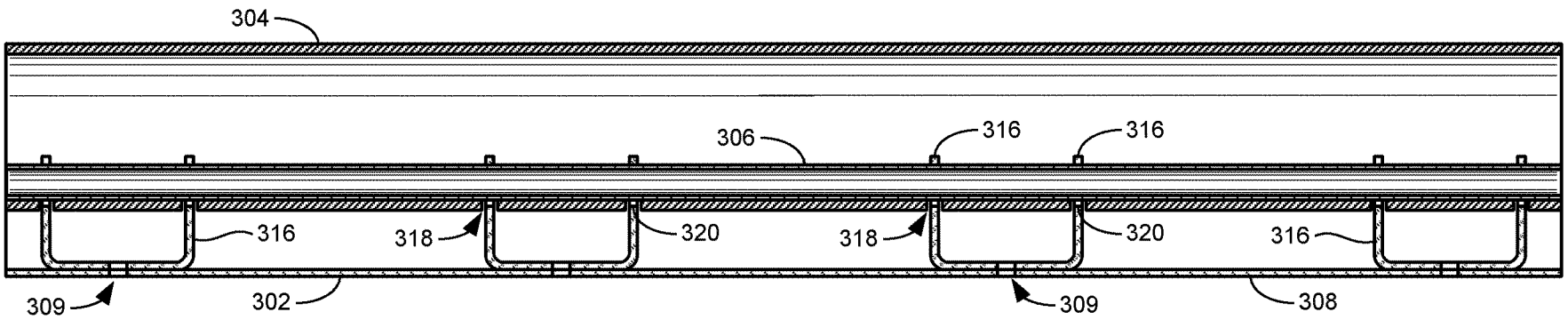
Figure 8:
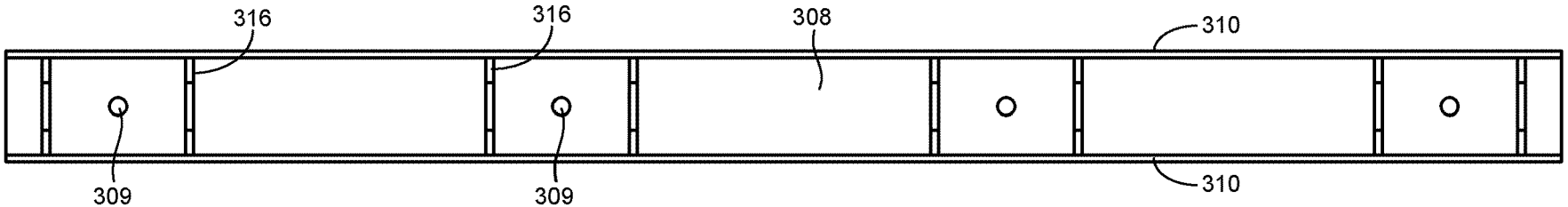

FIGS. 3-8 illustrate an example floor rail 300 that may be used to implement the floor rails 108 in the barrier systems 100, 200 of FIGS. 1 and/or 2. More particularly, FIG. 3 illustrates an exploded view of the example floor rail 300 showing the separate components including a rigid base 302, an impact resistant tube 304, and a tube retaining bar 306 to secure the tube 304 to the base 302. FIG. 4 illustrates a top perspective view of the example floor rail 300. In the illustrated examples of FIGS. 3 and 4, the tube 304 is transparent for purposes of explanation so that the features within and behind the tube 304 are visible in the drawings. FIG. 5 illustrates an end view of the example floor rail 300. FIG. 6 illustrates an enlarged perspective view of an end of the example floor rail 300. FIG. 7 illustrates a cross-sectional side view of the example floor rail 300 taken along the line 7-7 of FIG. 5. FIG. 8 illustrates a top view of the base 302 of the example floor rail 300.

As shown in the illustrated examples, the base 302 includes a bottom plate 308 that extends between two sidewalls 310. In this example, the sidewalls 310 are substantially perpendicular to the bottom plate 308. As used herein, "substantially perpendicular" means exactly perpendicular or within 5 degrees of perpendicular. In other examples, the sidewalls may be non-perpendicular with the bottom plate 308. In some examples, the bottom plate 308 and the two sidewalls 310 are formed from a single continuous piece of steel. In some examples, the bottom plate 308 includes a plurality of mounting holes 309 (FIGS. 4, 7, and 8) to enable the base 302 to be anchored to the floor. In the illustrated example, the bottom plate 308 includes four mounting holes 309. However, in other examples, more or fewer mounting holes 309 may be used. Further, the mounting holes 309 may be at any suitable locations along the length of the base 302. The bottom plate 308 and the two sidewalls 310 define an elongate channel 312 that extends along a length of the base 302. In this example, the channel 312 is open at a top of the base 302 along the entire length of the base 302 to enable the tube 304 to be supported along the channel 312 by the top edges 314 of the two sidewalls 310. As most clearly shown in FIG. 5, the tube 304 has a diameter that is larger than the width of the base 302 such that the tube protrudes outward from the sidewalls 310 in both directions while resting on the top edges 314 of the sidewalls 310. As a result, the tube 304 is likely to be the first portion of the floor rail 300 that is contacted during an impact. In this manner, the tube 304 is enabled to absorb at least some of the force of the impact before other components (e.g., the base 302) are struck during an impact. While the tube 304 extends out farther than other components of the floor rail 300, because the tube 304 is round and positioned on the top edges 314 of the spaced apart sidewalls 310, a bottom edge of the tube 304 (e.g., at point 502 shown in FIG. 5) is below the top edges 314 of the sidewalls 310.

In some examples, the base 302 includes tabs 316 that protrude upward from the bottom plate 308 and beyond the top edges 314 of the sidewalls 310. As shown in the illustrated example, the tabs 316 are oriented substantially perpendicular to the sidewalls 310. In some examples, each tab 316 is separately attached (e.g., via welding) to the bottom plate 308 and/or the sidewalls 310 of the base 302. In other examples, as shown most clearly in FIG. 7, adjacent pairs of the tabs 316 correspond to separate ends of a single C-shaped bracket that is positioned (e.g., via welding) within the channel 312 of the base 302. In the illustrated examples, the mounting holes 309 extend through the C-shaped brackets associated with the tabs 316. In other examples, some or all of the mounting holes 309 may be spaced apart from the C-shaped brackets. In other examples, the tabs 316 may be integrally formed with the base 302

(e.g., the tabs 316 corresponding to cutout portions of the bottom plate 308 that have been bent upwards).

In some examples, the tabs 316 are positioned along the length of the base 302 to align with corresponding slots 318 in the tube 304. As a result, due to the height of the tabs 316, when the tube 304 is positioned along the channel 312 to rest on the top edges 314 of the two sidewalls 310, the tabs 316 pass through the slots 318 and into the interior of the tube 304. As a result, the tabs 316 serve as retainers to prevent horizontal shifting of the tube 304 relative to the base 302. As shown in the illustrated examples, the portion of the tabs 316 that extends through the slots 318 of the tube 304 includes a hole, slot, or opening 320. The holes 320 in the tabs 316 are dimensioned large enough to enable the tube retaining bar 306 to pass therethrough. That is, in some examples, after the tube 304 is positioned on the base 302 with the tabs 316 extending through the slots 318, the bar 306 is passed through the holes 320 in the tabs 316 to secure the tube 304 against the base 302. In this example, the bar 306 is a hollow tube. In other examples, the bar 306 may be solid. In other examples, the bar 306 may have any other suitable shape.

In some examples, the tabs 316 and associated holes 320 are dimensioned and positioned such that when the bar 306 extends through the holes 320, a bottom edge of the bar 306 (e.g., at point 504 shown in FIG. 5) is held below the top edges 314 of the sidewalls 310 of the base 302. Inasmuch as the bar 306 extends through the holes 320 of the tabs 316 above a bottom portion of the tube 304 (e.g., the bar 306 extends through the interior of the tube 304), a bottom edge of the tube 304 (e.g., at point 502 shown in FIG. 5) is necessarily maintained below the top edges 314 of the sidewalls 310 of the base 302. Further, in some examples, the position of the bar 306 within the holes 320 of the tabs 316 creates an interference fit with the tube 304 at rest on the top edges 314 of the sidewalls 310 as represented by the overlap of the two components shown in FIG. 5. As a result, when the bar 306 is installed within the tube 304 and passed through the tabs 316, the bar 306 urges the bottom portion of the tube 304 downward and into the channel 312, thereby ensuring the tube 304 is securely held against the base 302. In this manner, there is no gap, through which an object can pass, between a top of the floor rail 300 and the floor to which the floor rail 300 is mounted.

FIGS. 9-15 illustrate another example floor rail 900 that may be used to implement the floor rails 108 in the barrier systems 100, 200 of FIGS. 1 and/or 2. The example floor rail 900 of FIGS. 9-15 is similar in design to the example floor rail 300 of FIGS. 3-8. Accordingly, the same reference numerals will be used for the same or similar features and the description of the similar features described above applies with respect to the corresponding features in FIGS. 9-15. Thus, as with the example floor rail 300 of FIGS. 3-8, the example floor rail 900 of FIGS. 9-15 includes a base 302 with a bottom plate 308 and two sidewalls 310 that define an elongate channel 312 along which an impact resistant tube 304 is positioned. However, the example floor rail 900 of FIGS. 9-15 differs from the example floor rail 300 of FIGS. 3-8 in the way the tube 304 is secured against the top edges 314 of the sidewalls 310 of the base. Specifically, the base 302 of FIGS. 9-15 includes tabs 902 that have a different shape and structure than the tabs 316 of FIGS. 3-8 to engage with a differently shaped tube retaining bar 904. However, similar to the tabs 316 of FIGS. 3-8, the tabs 902 of FIGS. 9-15 also serve as retainers to prevent horizontal shifting of the tube 304 relative to the base 302.

Figure 9:
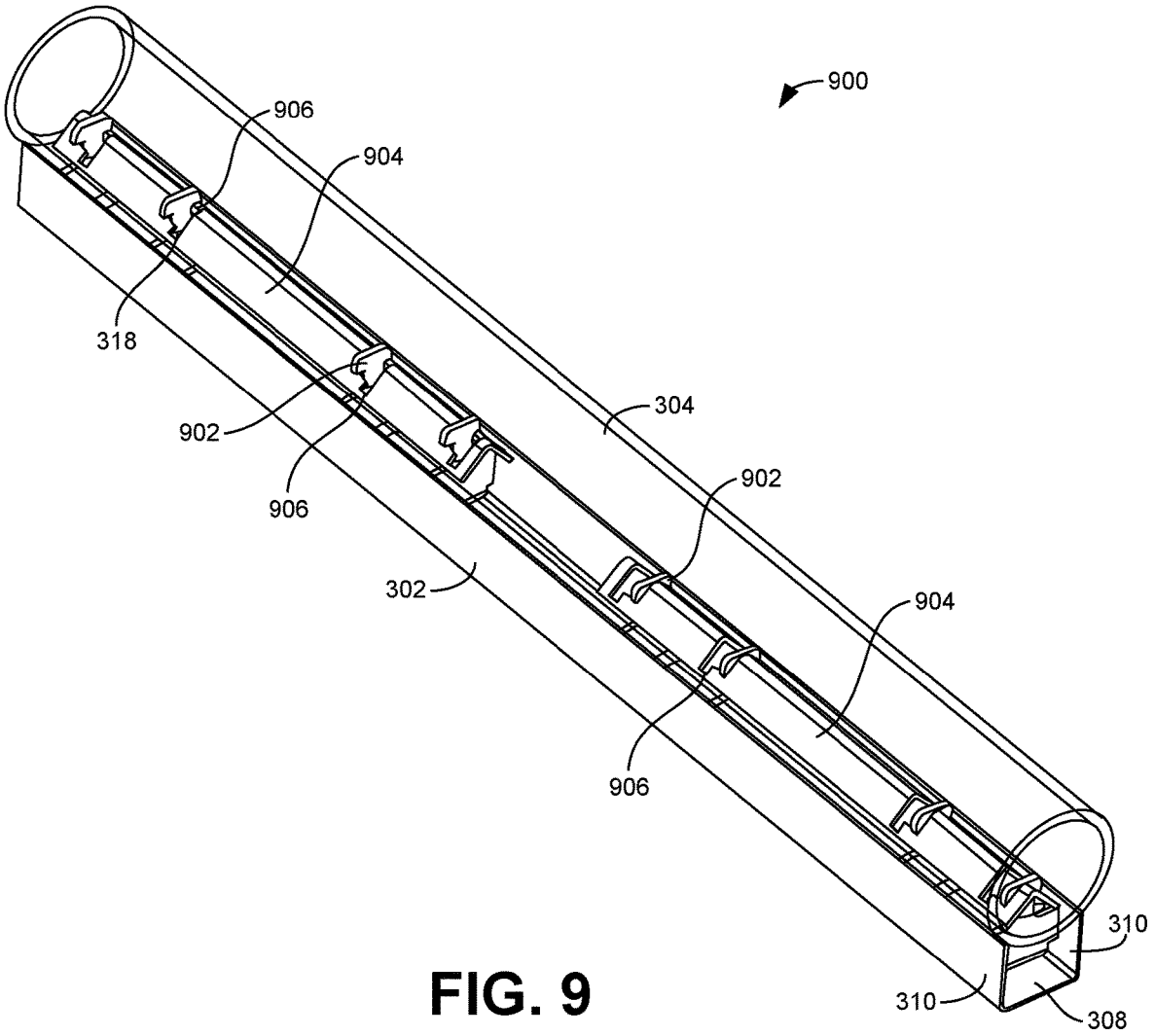
FIGS. 9-15 illustrate different views of another example floor rail that may be used to implement the example floor rails in the example barrier systems of FIGS. 1 and/or 2.
Figure 10:
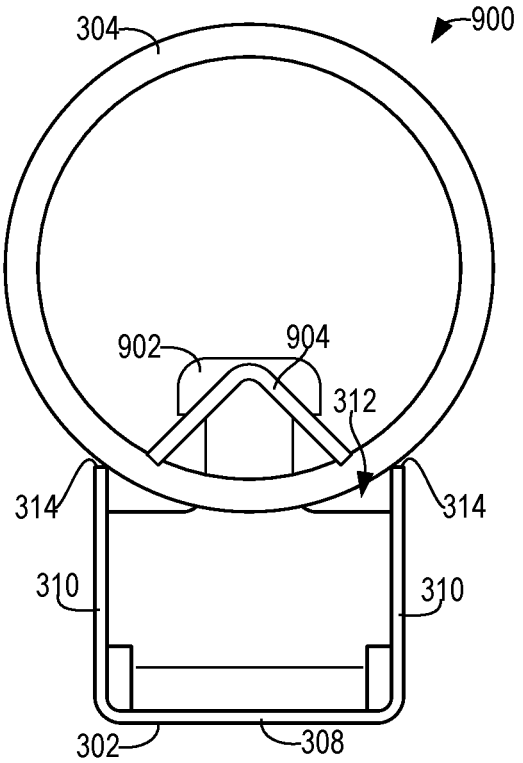
Figure 11:
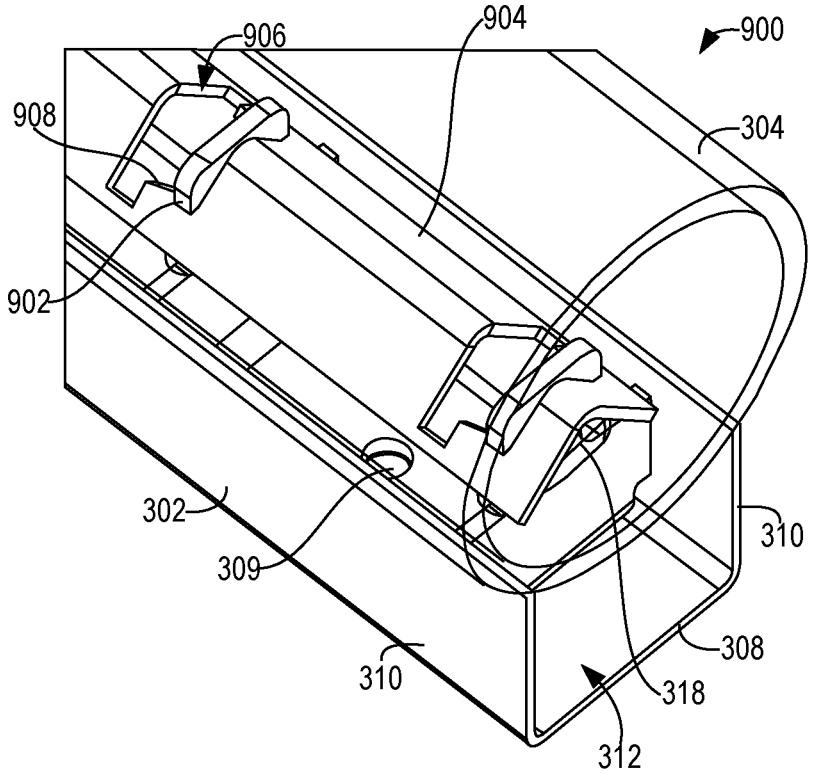
Figure 12:
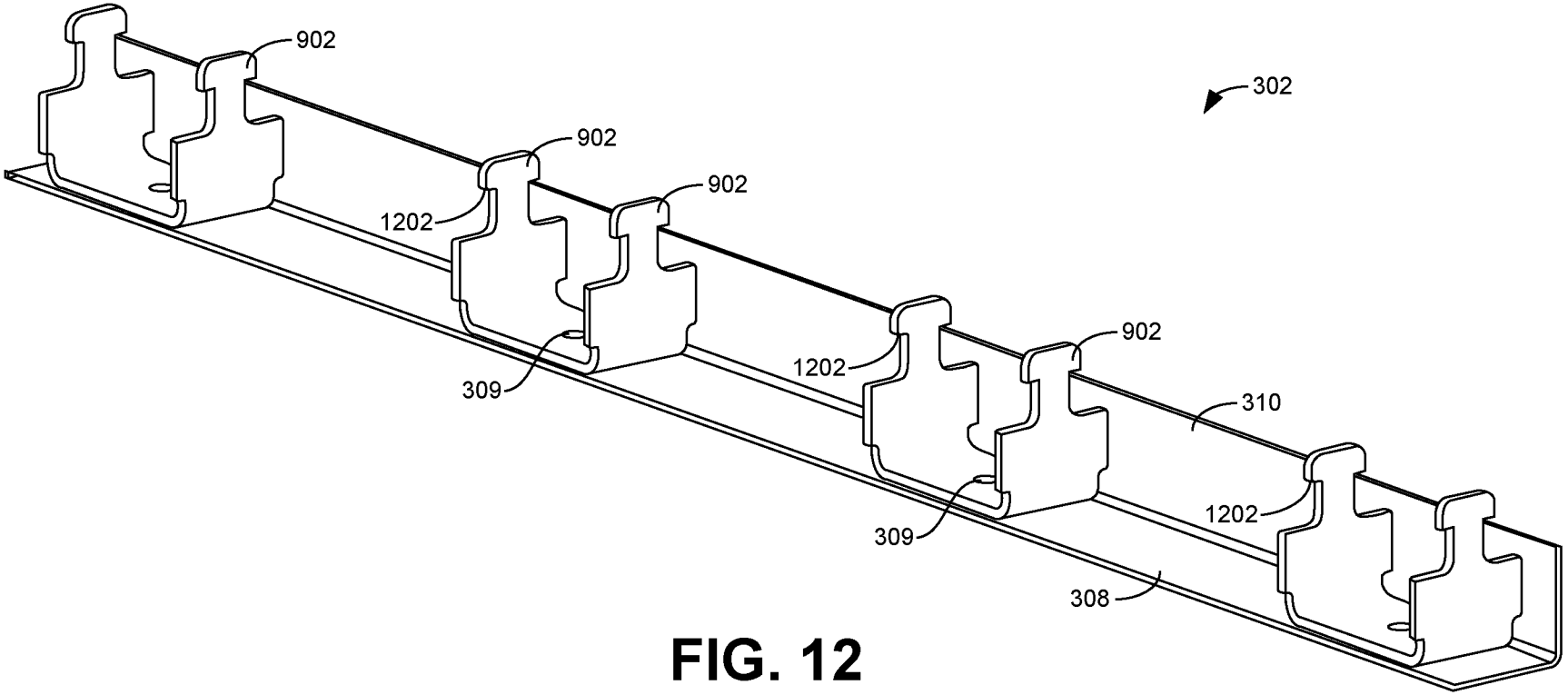
Figure 13:
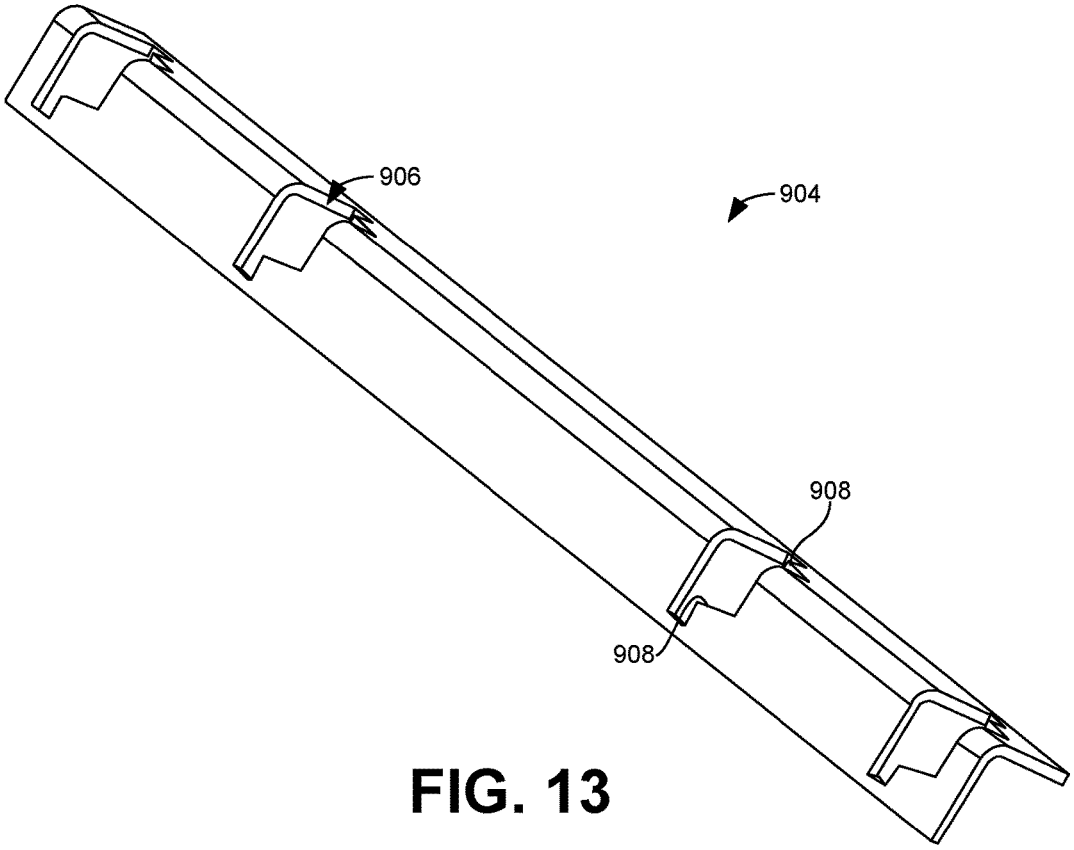
Figure 14:
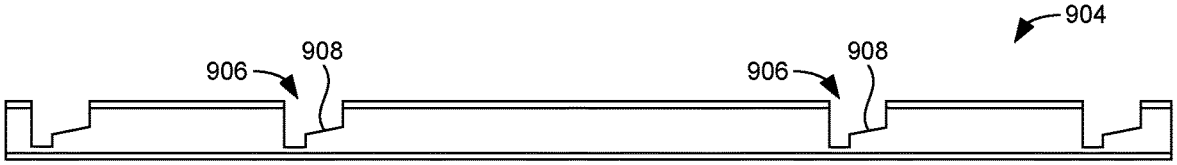
Figure 15:
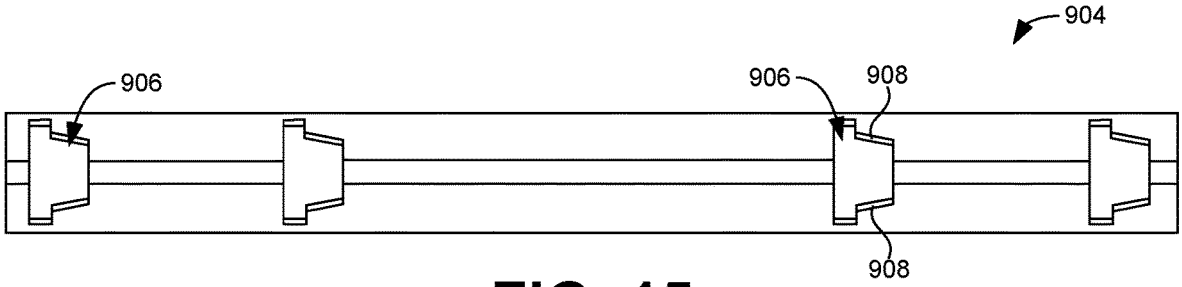

Turning in detail to the drawings of this example, FIG. 9 illustrates a top perspective view of the example floor rail 900. FIG. 10 illustrates an end view of the example floor rail 900. FIG. 11 illustrates an enlarged perspective view of an end of the example floor rail 900. FIG. 12 illustrates a partially cutaway view of the example base 302 of the example floor rail 900. More particularly, one of the sidewalls 310 has been cutaway in the illustrated example of FIG. 12. FIG. 13 illustrates a perspective view of the example tube retaining bar 904. FIG. 14 illustrates a side view of the example tube retaining bar 904. FIG. 15 illustrates a top view of the example tube retaining bar 904. In the illustrated examples of FIGS. 9 and 11, the tube 304 is transparent for purposes of explanation so that the features within and behind the tube 304 are visible in the drawings.

As shown in the illustrated examples, the tabs 902 protrude upward from the bottom plate 308 and beyond the top edges 314 of the sidewalls 310 of the base 302. Further, as discussed above in connection with the illustrated example of FIGS. 3-8, the tabs 902 in the illustrated examples of FIGS. 9-15 also extend through slots 318 in the tube 304. However, as shown in the illustrated examples of FIGS. 9-15, the tabs 902 do not include holes through which a bar passes. Rather, the tabs 902 pass through holes or openings 906 in the tube retaining bar 904. More particularly, in the illustrated example of FIGS. 9-15, the tube 304 is secured by two separate bars 904 positioned adjacent each end of the tube 304. In other examples, a single bar 904 extending substantially the entire length of the tube (similar to what is shown in FIGS. 3-8) may alternatively be used.

As shown in the illustrated example, the tabs 902 have a generally T-shaped profile that passes through generally T-shaped openings 906 in the bar 904. In this example, the cross-bars (i.e., distal section) of the T-shaped portions of the tabs 902 are dimensioned with a width that is less than the width of the cross-bars of the T-shaped openings 906 in the bar 904 to enable the tabs 902 to pass therethrough. However, the width of the cross-bars of the T-shaped portions of the tabs 902 is greater than the width of the stems or trunk (i.e., narrow section) of the T-shaped openings 906 in the bar 306. As a result, after the tabs 902 are extended through the openings 906, the bar 904 can be moved in a direction transverse to the tabs 902 (and along a length of the tube 304) to cause the cross-bar of the T-shaped portion of the tabs 902 to interlock with the stem or trunk of the T-shaped openings 906. In some examples, as shown most clearly in FIG. 14, the openings 906 in the bar 904 include an angled surface 908 along the stem or trunk portion of the T-shape of the openings 906 that is angled relative to the horizontal direction. As a result, as the bar 904 is moved relative to the tabs 902, the underside 1202 (FIG. 12) of the cross-bar of the T-shaped portion of the tabs 902 engages with and urges the bar 904 downward. This, in turn, urges the tube 304 downward due to the interference fit between the bar 904 and the tube 304 as represented by the overlap of the two components shown in FIG. 10. As a result, the tube 304 is securely held against the top edges 314 of the sidewalls 310, thereby preventing any gap between the top of the floor rail 900 and the floor to which the floor rail 900 is mounted.

In some examples, the tabs 902, the bar 904, and/or the openings 906 in the bar 904 may have different structures and/or shapes than shown in the illustrated example and still produce a downward force on the tube 304 to securely retain the tube 304 against the base 302 and within the channel 312. For instance, in some examples, rather than the openings 906 having the angled surfaces 908, the tabs 902 may have an angled surface that engages the bar 904. In some examples, such an angled surface on the tabs 902 is achieved by orienting the tabs 902 at a non-vertical angle. In some examples, both the tabs 902 and the openings include angled surfaces that engage one another to create the interference fit as the surfaces are slid or moved against one another. Further, although the bar 904 is shown as a piece of sheet metal that has been bent along its length, in other examples, the bar 904 may be implemented using any other suitable shape (e.g., a hollow tube, solid bar stock, a flat bar, etc.).

Figure 16:
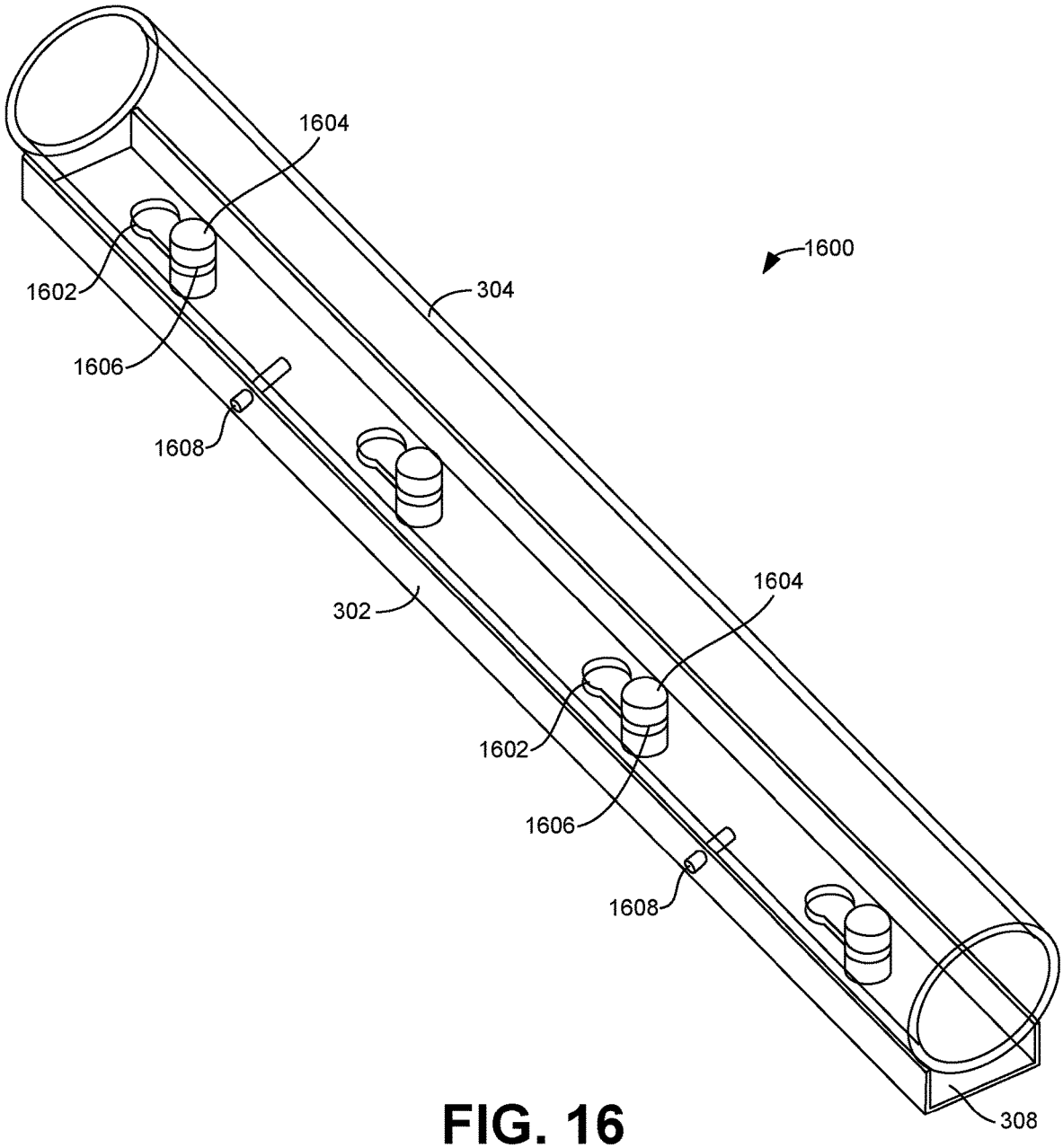
FIG. 16 is a perspective view of another example floor rail that may be used to implement the example floor rails in the example barrier systems of FIGS. 1 and/or 2.

FIG. 16 is a perspective view of another example floor rail 1600 that may be used to implement the example floor rails 108 in the example barrier systems of FIGS. 1 and/or 2. In this example, the tube 304 is held against the base 302 without a bar engaging with tabs protruding through slots in the tube 304. Rather, as shown in the illustrated example, the tube 304 includes keyhole slots 1602 that directly engage with tabs 1604 protruding upwards from the bottom plate 308 of the base 302. More particularly, in this example, the tabs 1604 are cylindrical protrusions (e.g., made from solid bar stock) with a stepped profile that defines a narrow neck 1606 dimensioned to slide within the narrow portion of the keyhole slots 1602. In other examples, the tabs 1604 may be any other suitable shape (e.g., flat with a T-shaped profile similar to the tabs 902 shown in FIGS. 9-12). Likewise, the slots 1602 may be any suitable shape to allow passage of the tabs 1604 and also to interlock with the tabs 1604 so that the tabs 1604 serve as retainers to prevent horizontal shifting of the tube 304 relative to the base 302. Additionally or alternatively, in some examples, one or more other retainers (e.g., a pin or other detent) 1608 extends through both the base 302 and the tube 304 to prevent horizontal shifting of the tube 304 relative to the base 302.

The foregoing examples of the floor rails 108, 300, 900, 1600 teach or suggest different features. Although each example floor rail 108, 300, 900, 1600 disclosed above has certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Figure 17:
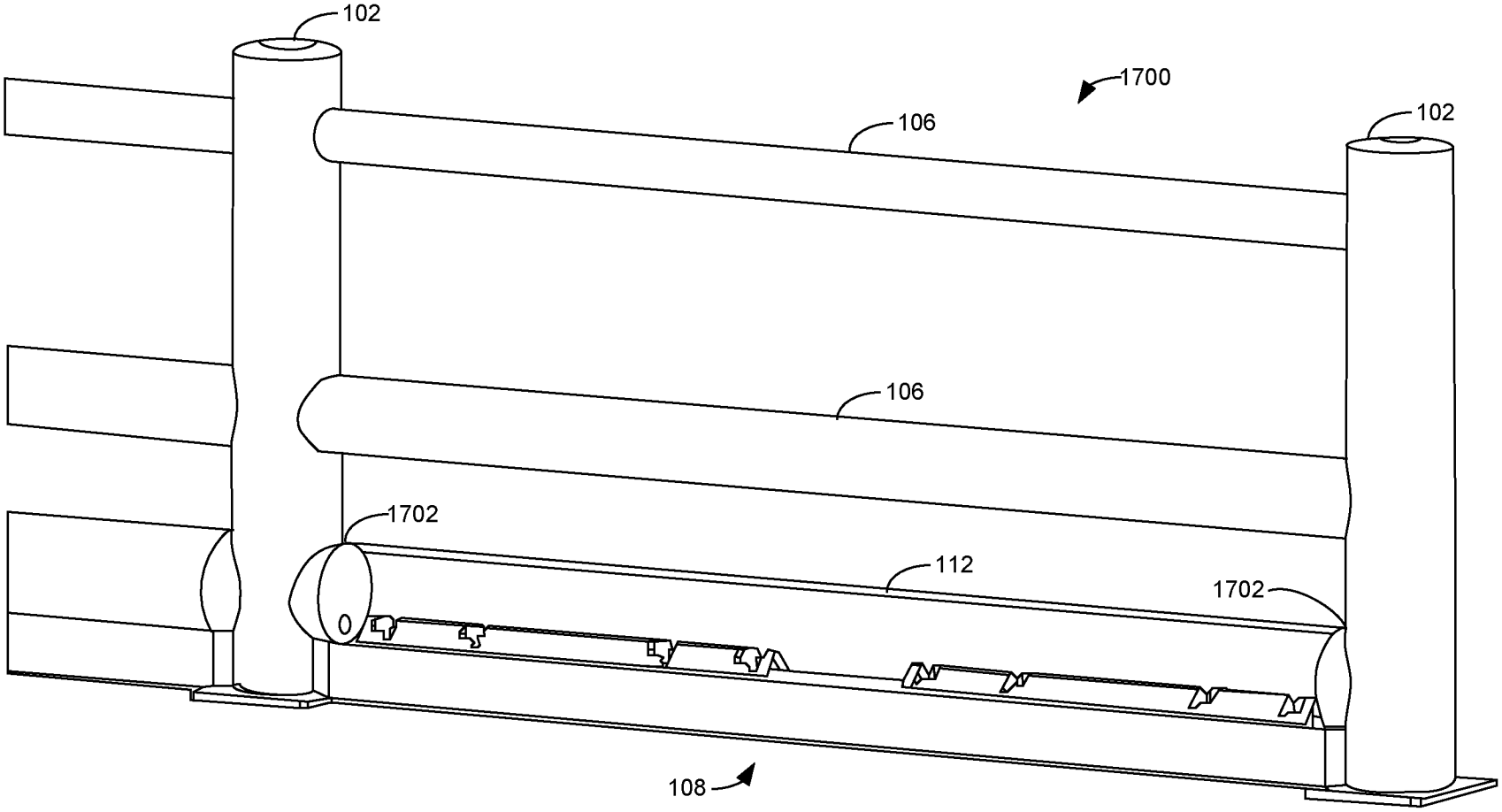
FIG. 17 is a perspective view of another example barrier system including example floor rail transition sections.

FIG. 17 is a perspective view of another example barrier system 1700 including example floor rail transition sections 1702. In the illustrated example, similar reference numbers are used for similar parts. The example barrier system 1700 of FIG. 17 differs from the example barrier system of FIG. 1 in that the guard rails 106 in FIG. 17 have different cross-sectional diameters (e.g., the upper guard rail 106 has a smaller diameter than the lower guard rail 106). Further, unlike the barrier system 100 of FIG. 1, the barrier system 1700 of FIG. 17 includes the floor rail transition sections 1702. However, in some examples, the barrier system 100 of FIG. 1 may also include the floor rail transition sections 1702 as disclosed herein. In the illustrated example of FIG. 17, each of the floor rail transition sections 1702 is used to couple a respective one of the floor rails 108 to a respective one of the posts 102. In the illustrated example of FIG. 17, the tube 112 is transparent for purposes of explanation so that the features within and behind the tube 304 are visible in the drawings.

In the example of FIG. 17, each of the floor rail transition sections 1702 in FIG. 17 is positioned against (e.g., abutting, in contact with, mated to) both a respective one of the floor rails 108 and a respective one of the posts 102. Thus, in some examples, the floor rail transition sections 1702 span corresponding gaps between respective ones of the floor rails 108 and respective ones of the posts 102 (e.g., the gaps 116 shown in FIG. 1). In some examples, the floor rail transition sections 1702 span corresponding gaps between respective ones of the floor rails 108 and respective ones of the posts 102. In some examples, at least one of the floor rail transition sections 1702 is fixedly coupled to (e.g., mounted to, attached to) at least one of a respective one of the floor rails 108 or a respective one of the posts 102 while merely abutting against the other one of the respective floor rail 108 or post 102. In some examples, ones of the floor rail transition sections 1702 are fixedly coupled to (e.g., mounted to, attached to) both a respective one of the floor rails 108 and a respective one of the posts 102. As such, in some examples, the floor rail transition sections 1702 reduce and/or eliminate the gaps between the posts 102 and the corresponding floor rails 108. Furthermore, the floor rail transition sections 1702 reduce and/or otherwise prevent displacement and/or removal of the floor rails 108 from the corresponding ones of the posts 102.

Figure 18:
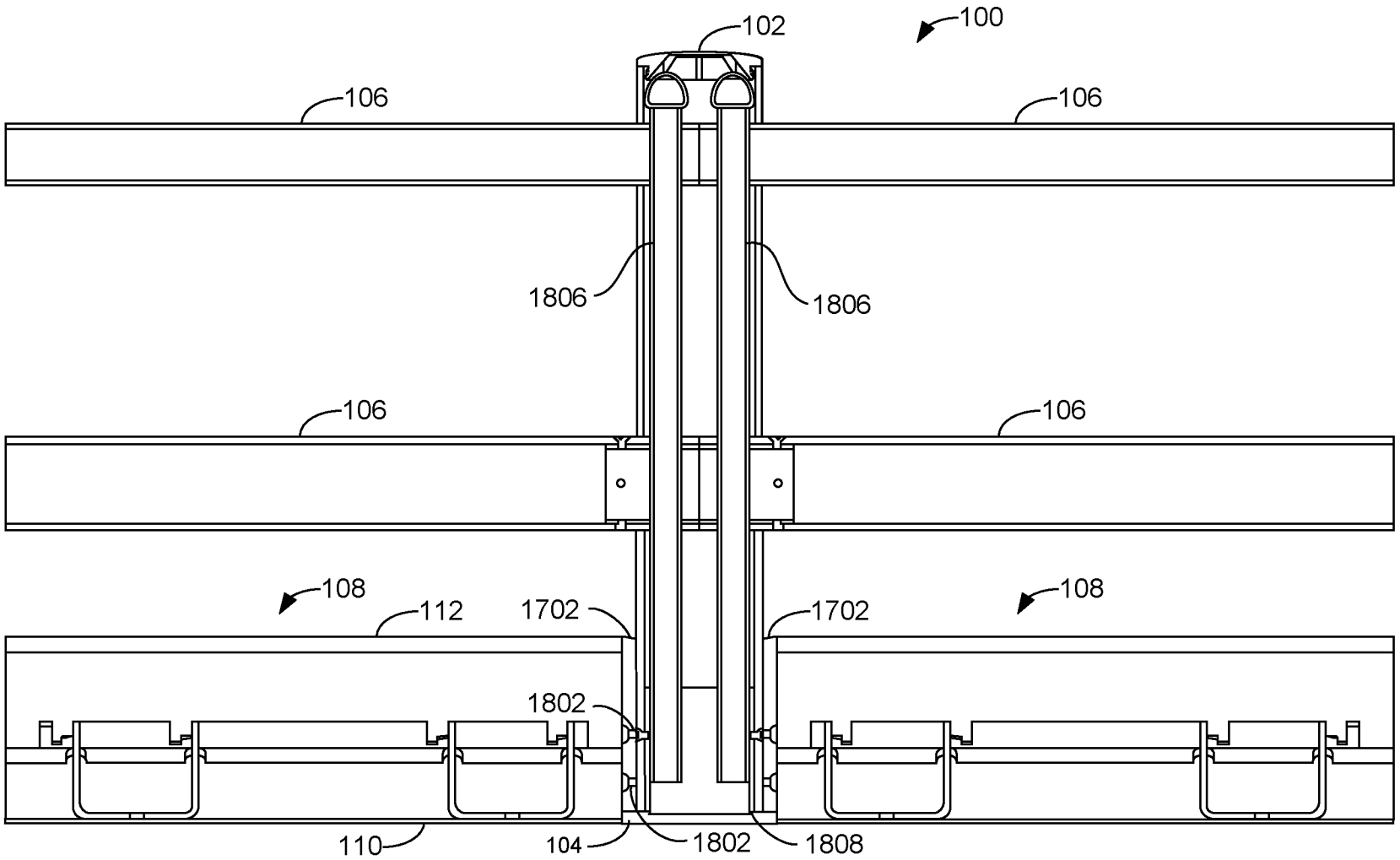
FIG. 18 is a cross-sectional view of the example barrier system of FIG. 17.

FIG. 18 is a cross-sectional view of the example barrier system 1700 of FIG. 17. In the illustrated example of FIG. 18, the floor rail transition sections 1702 are coupled between (e.g., abutting, mated between, positioned between) the post 102 and ends of respective ones of the floor rails 108. In some examples, example fasteners (e.g., screws, bolts, etc.) 1802 are used to fixedly couple the floor rail transition sections 1702 to the post 102 and/or to an example support structure 1808 disposed in the post 102. In this example, two fasteners 1802 are used. However, in other examples, only one fastener 1802 or more than two fasteners 1802 may be used.

In this example, the floor rails 108 do not include the example end caps 114 of FIG. 2. In this example, ends of the base 110 and the tube 112 of respective ones of the floor rails 108 abut the floor rail transition sections 1702, such that the floor rail transition sections 1702 prevent contact and/or reduce gaps between the floor rails 108 and the post 102. In some examples, the floor rails 108 include the end caps 114 of FIG. 2, and the floor rails 108 can be coupled to the floor rail transition sections 1702 via the fasteners 1802 disposed in the end caps 114. In this example, the example support structure 1808 is disposed in the post 102 between retaining members 1806 and an inner surface of the post 102. In some examples, the support structure 1808 increase strength of the post 102 and/or the floor rail transition sections 1702 to resist decoupling and/or displacement caused by impacts to the barrier system 1700.

Figure 19:
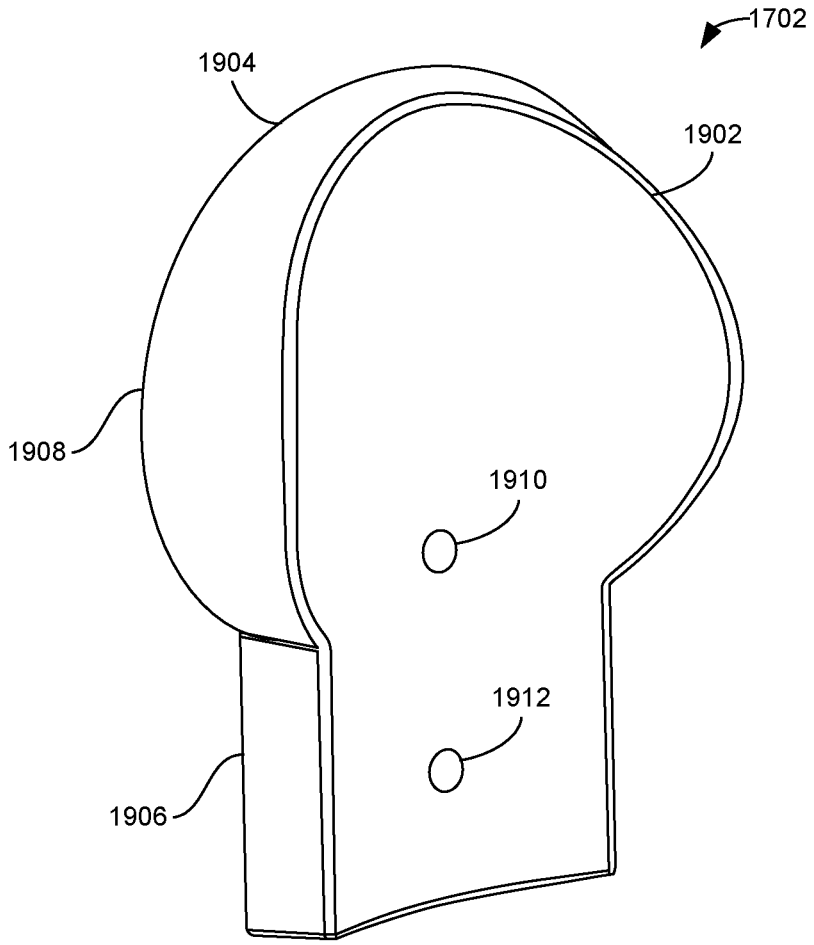
FIG. 19 is a detailed view of one of the example floor rail transition sections of FIGS. 17 and/or 18.

FIG. 19 is a detailed view of one of the example floor rail transition sections 1702 of FIGS. 17 and/or 18. In the illustrated example of FIG. 19, the floor rail transition section 1702 includes a first example surface 1902 to face a respective one of the posts 102 of the example barrier system 1700 of FIGS. 17 and/or 18, and further includes a second example surface 1904 to face a respective one of the floor rails 108. In some examples, the floor rail section 1702 has a thickness between the first and second surfaces 1902, 1904 corresponding to a distance between the post 102 and an outer edge or perimeter of the base plate 104 supporting the post 102. In this manner, the second surface 1904 can be aligned with and/or substantially flush with the outer edge or perimeter of the base plate 104. In this example, a curve of the first surface 1902 corresponds to a curved surface of the post 102 (e.g., matching cylindrical surfaces). Furthermore, the second surface 1902 is substantially flat (e.g., planar) in this example. As such, when the floor rail transition section

1702 is disposed between the post 102 and an end of a respective one of the floor rails 108, the floor rail transition section 1702 is mated to the post 102 and the end of the respective one of the floor rails 108 to reduce and/or eliminate gaps therebetween.

In some examples, the transition section 1702 is designed with a cross-sectional shape that generally matches the cross-sectional shape of the floor rail 108 (e.g., the shape collectively defined by the base 110 and the tube 112). In the illustrated example, the floor rail transition section 1702 has a bottom portion 1906 that is dimensioned and shaped to generally correspond to a cross-sectional shape of the base 110 of the floor rail 108. Thus, in this example, the bottom portion 1906 has a generally rectangular shape. In this example, the floor rail transition section 1702 has an upper portion 1908 that is dimensioned and shaped to generally correspond to a cross-sectional shape of the tube 112 of the floor rail 108. Thus, in this example, the upper portion 1908 has a generally circular shape. In other examples, a different shape may be used for at least one of the bottom portion 1906 or the upper portion 1908.

In the illustrated example, the floor rail transition section 1702 includes example openings 1910, 1912 extending between the first and second surfaces 1902, 1904. In some examples, the example fasteners 1802 of FIG. 18 are inserted and/or otherwise disposed in corresponding ones of the openings 1910, 1912 to couple the floor rail transition section 1702 to the post 102. While the floor rail transition section 1702 includes two of the openings 1910, 1912 in this example, a different number of openings can be used instead. In this example, the floor rail transition section 1702 is composed of a hard urethane material. In other examples, one or more different materials may be used for the floor rail transition section 1702 instead.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects, and/or things, the phrase "at least one of A and B" is intended to refer to implementations including any of (1) at least one A, (2) at least one B, or (3) at least one A and at least one B. Similarly, as used herein in the context of describing structures, components, items, objects, and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities, and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities, and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

Further examples and combinations thereof include the following:

Example 1 includes a barrier system comprising a base to be anchored to a floor, the base including sidewalls defining a channel along a length of the base, and a tube to extend along the channel, a bottom edge of the tube to be below top edges of the sidewalls.

Example 2 includes the barrier system of example 1, wherein the tube has a diameter that is greater than a width of the base.

Example 3 includes the barrier system of any one of examples 1 or 2, further including a plurality of tabs distributed along the channel, the tabs to protrude into an interior of the tube through slots in the tube.

Example 4 includes the barrier system of example 3, further including a bar to engage with the tabs within the interior of the tube, the bar to secure the tube against the top edges of the sidewalls.

Example 5 includes the barrier system of example 4, wherein a first surface of the bar is to engage a second surface of a first one of the tabs, at least one of the first surface or the second surface to be angled relative to the floor such that the bar is urged downward as the first surface is moved relative to the second surface in a direction along the length of the base.

Example 6 includes the barrier system of any one of examples 4 or 5, wherein the tabs are to extend through openings in the bar.

Example 7 includes the barrier system of any one of examples 4 or 5, wherein the bar is to extend through openings in the tabs.

Example 8 includes the barrier system of example 3, wherein the tabs are shaped to interlock with the slots in the tube to retain the tube against the top edges of the sidewalls.

Example 9 includes the barrier system of any one of examples 1-8, wherein the tube is to be secured to the base along the length of the base such that there are no gaps between the floor and a top of the tube.

Example 10 includes the barrier system of any one of examples 1-9, wherein the tube is made of a resilient material and the base is made of metal.

Example 11 includes the barrier system of any one of examples 1-10, further including a retainer to maintain the horizontal position of the tube with respect to the base.

Example 12 includes the barrier system of any one of examples 1-11, further including a transition section disposed between an end of the tube and a post, the transition section to reduce a gap between the end of the tube and the post.

Example 13 includes the barrier system of example 12, wherein the transition section includes a urethane material.

Example 14 includes a barrier system comprising a floor rail to be anchored to a floor, a post to be anchored to the floor adjacent an end of the floor rail, and a transition section to abut the post and to extend between the post and the end of the floor rail.

Example 15 includes the barrier system of example 14, wherein the transition section includes a curved surface to matingly engage an exterior of the post and a flat surface to face the floor rail.

Example 16 includes the barrier system of any one of examples 14 or 15, wherein the transition section includes a urethane material.

Example 17 includes the barrier system of any one of examples 14-16, wherein the transition section includes an opening extending therethrough, the transition section to be coupled to the post via a fastener disposed in the opening.

Example 18 includes a barrier system comprising a base including an elongate base plate extending along a length of the base and opposing sidewalls on either side of the base plate, and a tube to extend along the length of the base, the tube to contact upper edges of the sidewalls along the length of the base.

Example 19 includes the barrier system of example 18, further including means for preventing horizontal shifting of the tube relative to the base.

Example 20 includes the barrier system of any one of examples 18 or 19, further including a post to be positioned adjacent an end of the base, the post to support a guard rail above the tube, and a transition section to fill a gap between the post and the end of the base.

Example 21 includes the barrier system of example 20, wherein the base and the tube collectively define a first cross-sectional shape and the transition section has a second cross-sectional shape, the second cross-sectional shape to match the cross-sectional shape.

The following claims are hereby incorporated into this Detailed Description by this reference. Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

What is claimed is:

1. A barrier system comprising:

a base to be anchored to a floor, the base including sidewalls defining a channel along a length of the base;

a tube to extend along the channel, a bottom edge of the tube to be below top edges of the sidewalls; and a plurality of tabs distributed along the channel, the tabs to protrude into an interior of the tube through slots in the tube.

2. The barrier system of claim 1, wherein the tube has a diameter that is greater than a width of the base.

3. The barrier system of claim 1, further including a bar to engage with the tabs within the interior of the tube, the bar to secure the tube against the top edges of the sidewalls.

4. The barrier system of claim 3, wherein a first surface of the bar is to engage a second surface of a first one of the tabs, at least one of the first surface or the second surface to be angled relative to the floor such that the bar is urged downward as the first surface is moved relative to the second surface in a direction along the length of the base.

5. The barrier system of claim 3, wherein the tabs are to extend through openings in the bar.

6. The barrier system of claim 3, wherein the bar is to extend through openings in the tabs.

7. The barrier system of claim 1, wherein the tabs are shaped to interlock with the slots in the tube to retain the tube against the top edges of the sidewalls.

8. The barrier system of claim 1, wherein the tube is to be secured to the base along the length of the base such that there are no gaps between the floor and a top of the tube.

9. The barrier system of claim 1, wherein the tube is made of a resilient material and the base is made of metal.

10. The barrier system of claim 1, further including a retainer to maintain a horizontal position of the tube with respect to the base.

11. The barrier system of claim 1, further including a transition section disposed between an end of the tube and a post, the transition section to reduce a gap between the end of the tube and the post.

12. The barrier system of claim 11, wherein the transition section includes a urethane material.

13. A barrier system comprising:

a base including an elongate base plate extending along a length of the base and opposing sidewalls on either side of the base plate;

a tube to extend along the length of the base, the tube to contact upper edges of the sidewalls along the length of the base;

a post to be positioned adjacent an end of the base, the post to support a guard rail above the tube; and a transition section to fill a gap between the post and the end of the base.

14. The barrier system of claim 13, further including means for preventing horizontal shifting of the tube relative to the base.

15. The barrier system of claim 13, wherein the base and the tube collectively define a first cross-sectional shape and the transition section has a second cross-sectional shape, the second cross-sectional shape to match the first cross-sectional shape.

* * * * *